US008430725B2

(12) United States Patent
Pajovic

(10) Patent No.: US 8,430,725 B2
(45) Date of Patent: Apr. 30, 2013

(54) ABRASIVE DISC CONSTRUCTION

(76) Inventor: Jovan Pajovic, Mississauga (CA)

( * ) Notice: Subject to any disclaimer, the term of this patent is extended or adjusted under 35 U.S.C. 154(b) by 842 days.

(21) Appl. No.: 12/339,997

(22) Filed: Dec. 19, 2008

(65) Prior Publication Data

US 2010/0159813 A1 Jun. 24, 2010

(51) Int. Cl.
*B24D 15/00* (2006.01)

(52) U.S. Cl.
USPC ..... 451/508; 451/510; 451/521

(58) Field of Classification Search ..... 451/508, 451/510, 521
See application file for complete search history.

(56) References Cited

U.S. PATENT DOCUMENTS

| | | | | |
|---|---|---|---|---|
| 998,615 | A * | 7/1911 | Huneke | 192/56.53 |
| 2,665,570 | A * | 1/1954 | Ream | 464/33 |
| 3,041,797 | A | 7/1962 | Moffly | |
| 3,046,709 | A * | 7/1962 | Cook | 451/510 |
| 3,683,566 | A * | 8/1972 | Walters | 451/488 |
| 3,927,537 | A * | 12/1975 | Anderson et al. | 192/56.53 |
| 4,015,371 | A | 4/1977 | Grayston | |
| 4,088,729 | A | 5/1978 | Sherman | |
| 4,240,230 | A | 12/1980 | Ferrantini | |
| 4,245,438 | A * | 1/1981 | van Buren, Jr. | 451/510 |
| 4,318,284 | A * | 3/1982 | van der Lely et al. | 464/33 |
| 4,541,205 | A | 9/1985 | Patrello | |
| 4,694,615 | A | 9/1987 | MacKay, Jr. | |
| 4,702,359 | A * | 10/1987 | Mancuso et al. | 192/56.53 |
| 4,754,577 | A | 7/1988 | MacKay, Jr. | |
| 4,760,670 | A | 8/1988 | MacKay, Jr. | |
| 4,774,788 | A | 10/1988 | Shacham et al. | |
| 4,794,737 | A | 1/1989 | Timmons et al. | |
| 5,201,149 | A | 4/1993 | Eisenblatter | |
| 5,538,464 | A | 7/1996 | MacKay, Jr. | |
| 5,628,679 | A * | 5/1997 | Shiga | 451/508 |
| 6,093,086 | A * | 7/2000 | Easter et al. | 451/41 |
| 6,332,836 | B1 | 12/2001 | Tseng | |
| 6,379,234 | B1 | 4/2002 | MacKay | |
| 6,454,639 | B1 | 9/2002 | Huber | |
| 6,712,683 | B2 | 3/2004 | Brandstetter | |
| 6,743,085 | B2 | 6/2004 | Fritz et al. | |
| D498,486 | S | 11/2004 | Eisenblaetter | |

(Continued)

FOREIGN PATENT DOCUMENTS

| | | |
|---|---|---|
| CA | 1305860 | 8/1992 |
| EP | 1795304 | 6/2007 |

OTHER PUBLICATIONS

Instruction Manual for Angle Grinders 9553NB, 9554NB, 9555NB Makita Corporation, Dec. 15, 2004.

(Continued)

*Primary Examiner* — Maurina Rachuba
(74) *Attorney, Agent, or Firm* — Tarolli, Sundheim, Covell & Tummino LLP

(57) ABSTRACT

An improved abrasive disc for use with an angle grinder is disclosed. The grinder is of the type having a threaded spindle. The disc is of the type having: a central portion defining a threaded bore for receiving said spindle; and abrasive material surrounding the central portion. The improvement comprises: a hub defining the threaded bore; an annular element providing the abrasive material, the annular element having a central primary aperture aligned with the threaded bore in the hub to provide access to the bore by said spindle in use; and elements mechanically securing the hub to the annular element, for co-rotation. Apparatus and methods for producing discs are also disclosed.

23 Claims, 13 Drawing Sheets

U.S. PATENT DOCUMENTS

| | | | | |
|---|---|---|---|---|
| 6,863,596 | B2 * | 3/2005 | Fritz et al. | 451/59 |
| 6,945,863 | B1 | 9/2005 | Hettes | |
| 7,056,200 | B2 | 6/2006 | Nelson | |
| 7,258,515 | B2 * | 8/2007 | Krondorfer | 451/508 |
| 7,357,702 | B2 | 4/2008 | Ficai | |
| 7,465,222 | B1 * | 12/2008 | Sun et al. | 451/342 |
| 7,588,484 | B2 * | 9/2009 | Momosaki | 451/508 |
| 7,722,445 | B2 * | 5/2010 | Kraenzler et al. | 451/508 |
| 2003/0068963 | A1 * | 4/2003 | Vanell | 451/72 |
| 2003/0104773 | A1 * | 6/2003 | Krondorfer et al. | 451/508 |
| 2005/0085174 | A1 | 4/2005 | Yanase | |
| 2006/0141917 | A1 * | 6/2006 | Gardner | 451/359 |
| 2006/0217048 | A1 * | 9/2006 | Frech et al. | 451/508 |
| 2006/0246827 | A1 * | 11/2006 | Gardner | 451/359 |
| 2007/0141970 | A1 | 6/2007 | MacKay | |

OTHER PUBLICATIONS

Instruction Manual for Dewalt DW400 Angle Grinder, Form No. 624539-00 Dewalt Industrial Tool Co., Oct. 2004.

Instruction Manual for Dewalt DW802, DW802G, Heavy Duty Small Angle Grinder Form 397649-00, Dewalt Industrial Tool Co., Dec. 2005.

Operators Manual for Catalog Nos. 6140,6141 and 6145 58-14-3350 d5, 'Milwaukee Electric Tool Corporation, Oct. 2004.

Accessories, www.walter.com, Nov. 29, 2007.

Blending, www.walter.com, Nov. 29, 2007.

Spin-On, www.walter.com, Dec. 4, 2007.

* cited by examiner

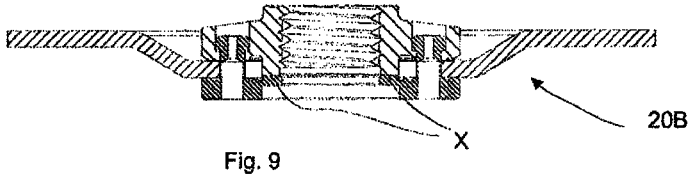
Fig. 9
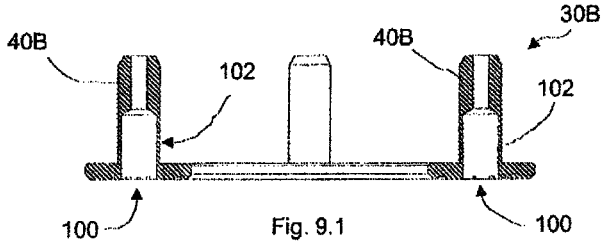
Fig. 9.1
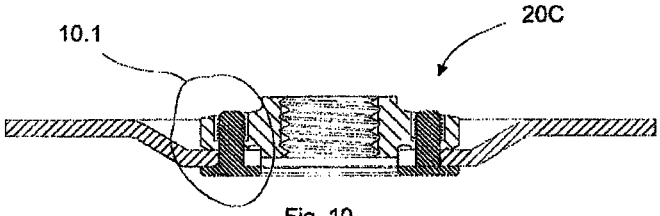
Fig. 10
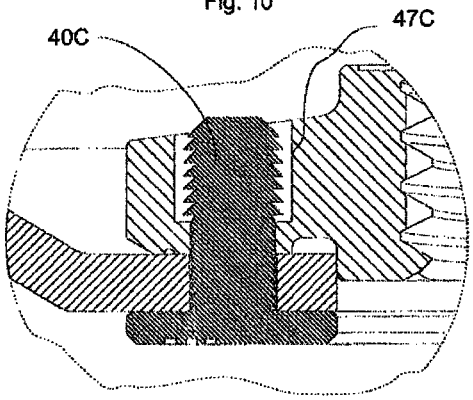
Fig. 10.1

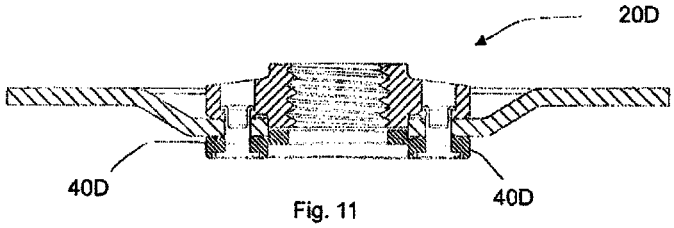
Fig. 11
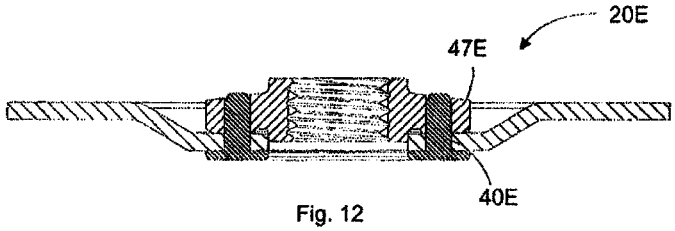
Fig. 12
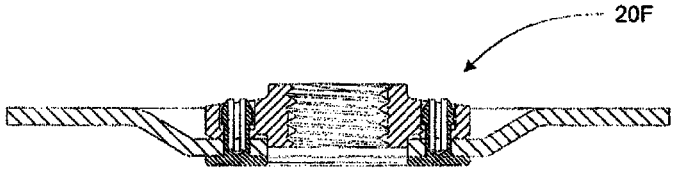
Fig. 12.1
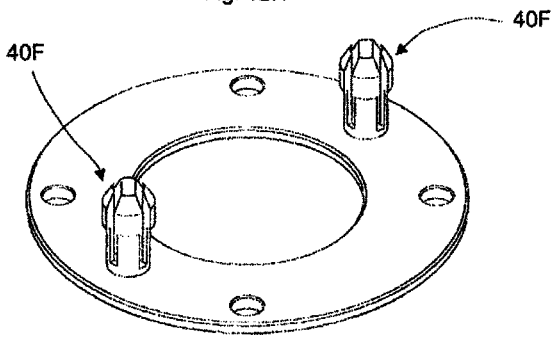
Fig. 12.1.1

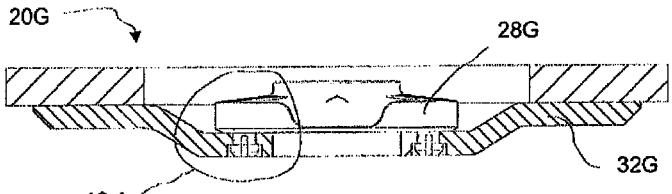
Fig. 13
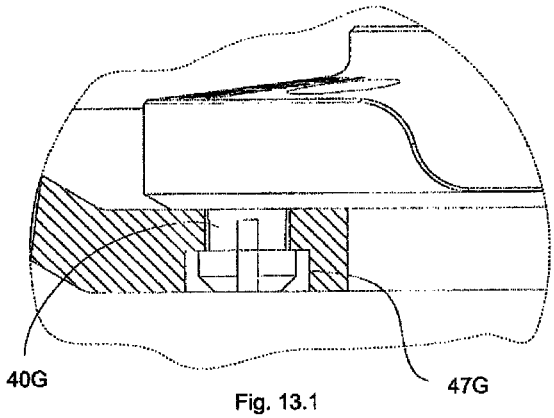
Fig. 13.1
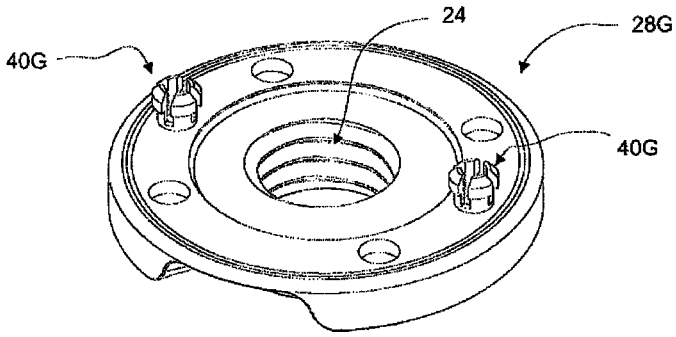
Fig. 13.2

ABRASIVE DISC CONSTRUCTION

FIELD OF THE INVENTION

The present invention relates to the field of abrasives.

BACKGROUND OF THE INVENTION

Abrasive discs for grinders are well known. Such discs ubiquitously include an annular abrasive element. Often, the grinder has a rotating threaded spindle, and the abrasive element is secured to the spindle by a nut. Alternatively, the abrasive element can be manufactured with an attached nut. Discs of this type are relatively convenient to replace, and thus, are relatively popular, notwithstanding that attaching a nut to an abrasive element in a manner that can withstand the very high rotation speeds associated with grinding operations can add substantial costs to manufacture.

SUMMARY OF THE INVENTION

An improved abrasive disc for use with an angle grinder forms one aspect of the invention. The grinder is of the type having a threaded spindle. The disc is of the type having: a central portion defining a threaded bore for receiving said spindle; and abrasive material surrounding the central portion. The improvement comprises: a hub defining the threaded bore; an annular element providing the abrasive material, the annular element having a central primary aperture aligned with the threaded bore in the hub to provide access to the bore by said spindle in use; and elements mechanically securing the hub to the annular element, for co-rotation.

According to another aspect of the invention, the elements can extend through the annular element to the hub.

According to another aspect of the invention, the annular element can have two or more secondary apertures spaced about the primary aperture; and the elements can be provided one for each secondary aperture and extend therethrough to the hub.

According to another aspect of the invention, a component can be provided, spacing apart the elements and from which the elements extend.

According to another aspect of the invention, the hub can have a socket for, and in receipt of, each element.

According to other aspects of the invention, the elements can be frictionally engaged by the hub; the elements can be adhesively secured to the hub; the elements can mechanically engage the hub; or the elements can be welded to the hub.

According to another aspect of the invention, the elements can have enlarged heads, disposed within the sockets and produced via a deformation operation, which mechanically secure the elements to the hub.

According to other aspects of the invention, the elements can be formed integrally with the component; or the elements can be formed separately from each of the hub and the component and defined by rivets.

According to another aspect of the invention, the elements can be formed integrally with the hub and extend therefrom through the annular element.

According to another aspect of the invention, the annular element can have two or more secondary apertures spaced about the primary aperture; and the elements can be provided one for each secondary aperture and extend therethrough.

According to another aspect of the invention, there can be further provided a component to which the elements extend.

According to another aspect of the invention, the component can have a socket for, and in receipt of, each element.

According to other aspect of the invention, the elements can be frictionally engaged by the component; the elements can be adhesively secured to the component; the elements can mechanically engage the component; or the elements can be welded to the component.

According to another aspect of the invention, the elements can have enlarged heads, disposed within the sockets and produced via a deformation operation, which mechanically secure the elements to the component.

According to another aspect of the invention, the annular element can have a socket for, and in receipt of, each element.

According to other aspects of the invention: the elements can be frictionally engaged by the annular element; the elements can be adhesively secured to the annular element; the elements can mechanically engage the annular element; and the elements can be welded to the annular element.

According to another aspect of the invention: the elements can have enlarged heads, disposed in the sockets and produced via a deformation operation, which mechanically secure the elements to the annular element.

According to another aspect of the invention: the annular element can have two or more secondary apertures spaced about the primary aperture; the elements can be provided one for each secondary aperture and extend therethrough; and the elements can be defined by rivets.

According to another aspect of the invention: the elements can be pins and, in the event that the disc binds in use, the pins can break, to permit the spindle to rotate freely of the annular element.

A method for producing an abrasive disc for use with an angle grinder forms another aspect of the invention. The grinder is of the type having a threaded spindle. The disc is of the type having: a central portion defining a threaded bore for receiving said spindle; and abrasive material surrounding the central portion. The method comprises: providing an annular element providing the abrasive material, the annular element having a central primary aperture and two or more secondary apertures spaced about the primary aperture; providing a hub defining the threaded bore; providing a pin for each secondary aperture; fitting each pin through the secondary aperture for which it is provided; and providing for the hub to be secured to the annular element via the pins.

According to another aspect of the invention, the pins can be provided as part of a spacer structure; the hub can have a socket for each pin; and each pin can be fitted into the socket which is provided therefor after passage through the secondary aperture for which it is provided.

According to another aspect of the invention, the pins can be secured to the hub via a mechanism selected from the group consisting of: deformation of the pin head; adhesive; welding; frictional engagement; and snap-fit.

According to another aspect of the invention, the pins can be provided as part of the hub; the annular element can have a socket for each pin; and the pins can be secured to the annular element via a mechanism selected from the group consisting of: deformation of the pin head; adhesive; welding; frictional engagement; and snap-fit.

According to another aspect of the invention, the pins can be frangible such that, in the event that the disc binds in use, the pins break, to permit the spindle and hub to rotate freely of the annular element.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF DESCRIPTION OF THE DRAWINGS

FIG. 9 is a view, similar to FIG. 4, of another exemplary embodiment;

FIG. 9.1 is an enlarged view of a portion of the structure of FIG. 9;

FIG. 10 is a view, similar to FIG. 4, of another exemplary embodiment;

FIG. 10.1 is a detail view of encircled area 10.1 of FIG. 10;

FIG. 11 is a view, similar to FIG. 4, of another exemplary embodiment;

FIG. 12 is a view, similar to FIG. 4, of another exemplary embodiment;

FIG. 12.1 is a view, similar to FIG. 4, of another exemplary embodiment;

FIG. 12.1.1. is a perspective view of a portion of the structure shown in sectional view in FIG. 12.1

FIG. 13 is a view, similar to FIG. 4, of another exemplary embodiment;

FIG. 13.1 is a detail view of encircled area 13.1 in FIG. 13;

FIG. 13.2 is a perspective view of a portion of the structure shown in sectional view in FIG. 13

DETAILED DESCRIPTION

Figure 1:
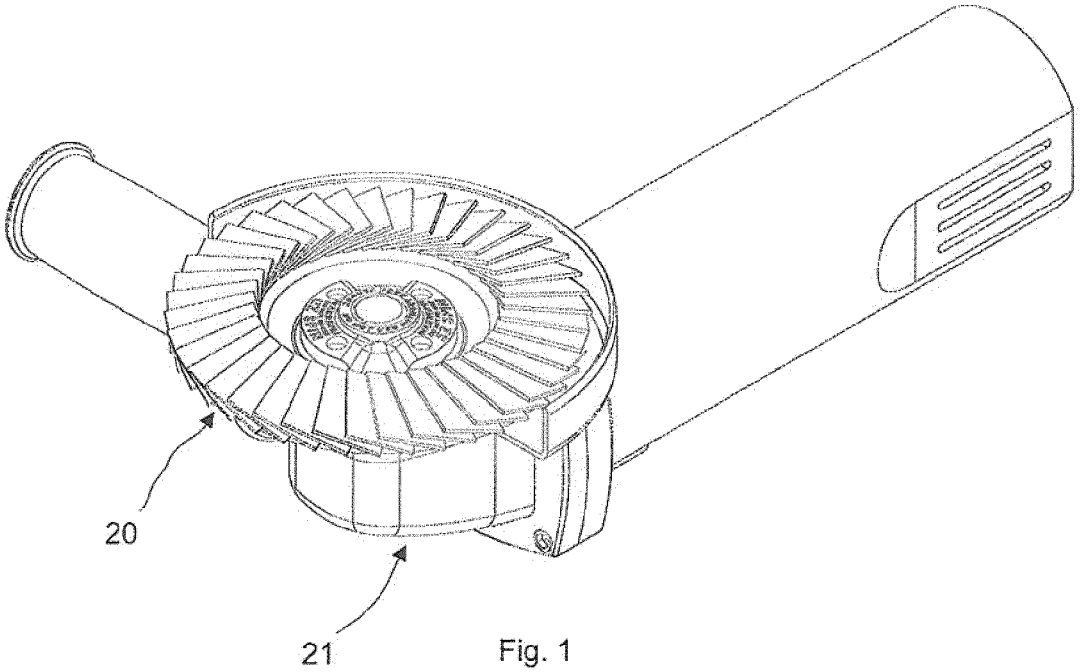
FIG. 1 is a perspective view of an abrasive disc according to an exemplary embodiment of the invention in use with an angle grinder.
Figure 2:
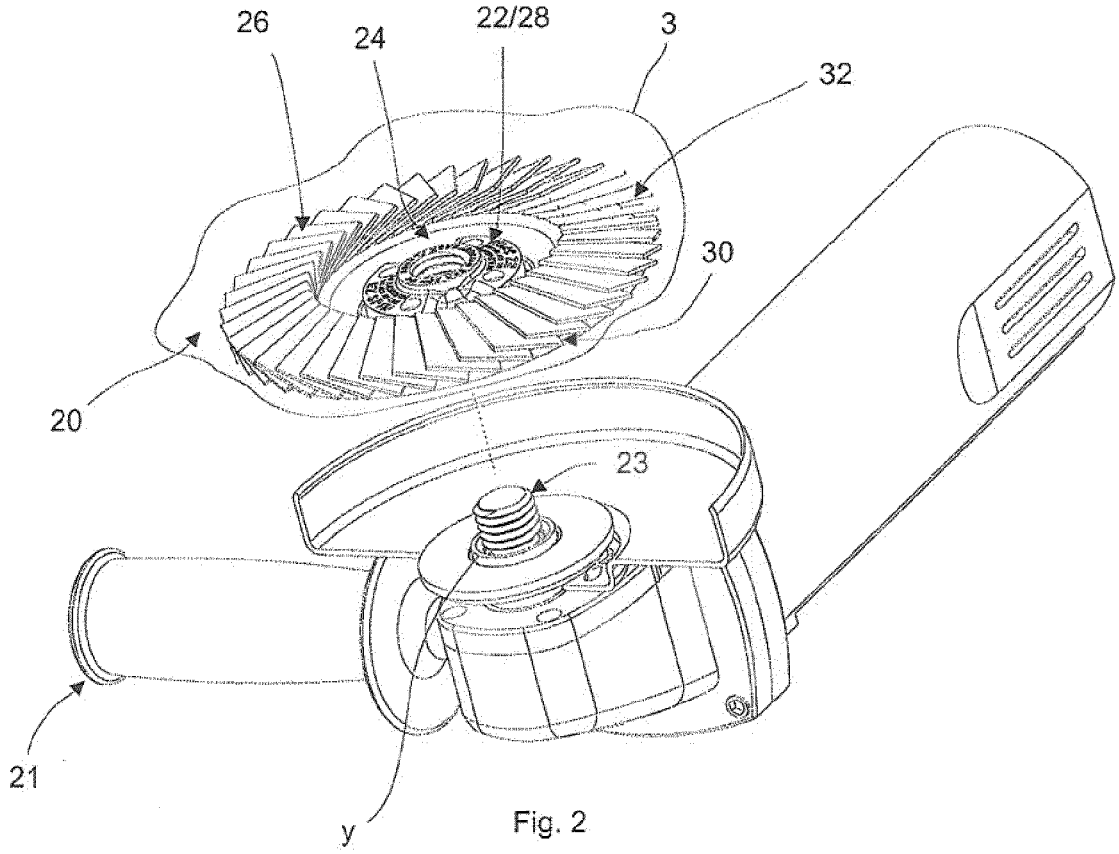
FIG. 2 is an exploded view of FIG. 1.
Figure 3:
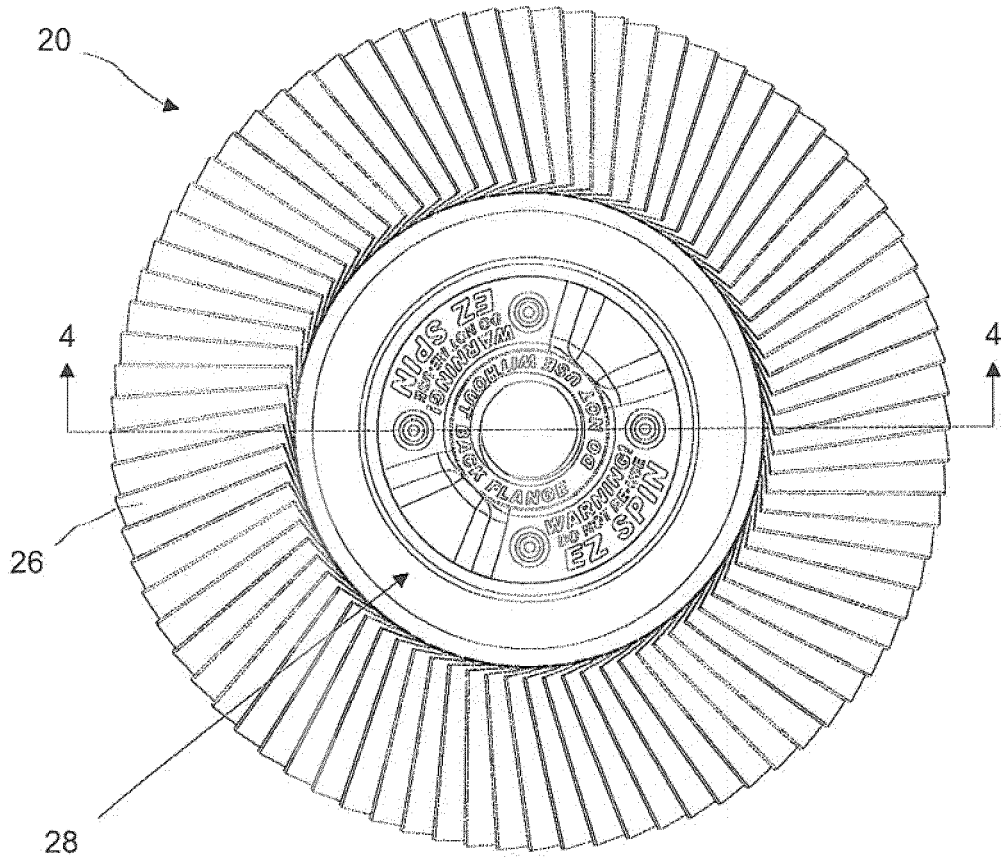
FIG. 3 is a plan view of encircled structure 3 of FIG. 2.

As indicated above, FIG. 1 shows an abrasive disc 20 according to an exemplary embodiment of the present invention in use with an angle grinder 21. As will be readily understood by persons of ordinary skill in the art, this disc 20 is of the well-known threaded type. The grinder 21 forms no part of the invention and is illustrated for ease of reference only. As best indicated in exploded FIG. 2, in common with other discs of this class, the illustrated disc 20 has a central portion 22 defining a threaded bore 24 for receiving the spindle 23 of the grinder 21 and has abrasive material 26 surrounding the central portion 22. However, in contradistinction to other devices of the subject class, this disc 20 is characterized in the presence of a hub 28 which defines the threaded bore 24, a spacer structure 30 and an annular element 32 which provides the abrasive material 26, which together form the disc 20, and as further described hereinafter.

Figure 5:
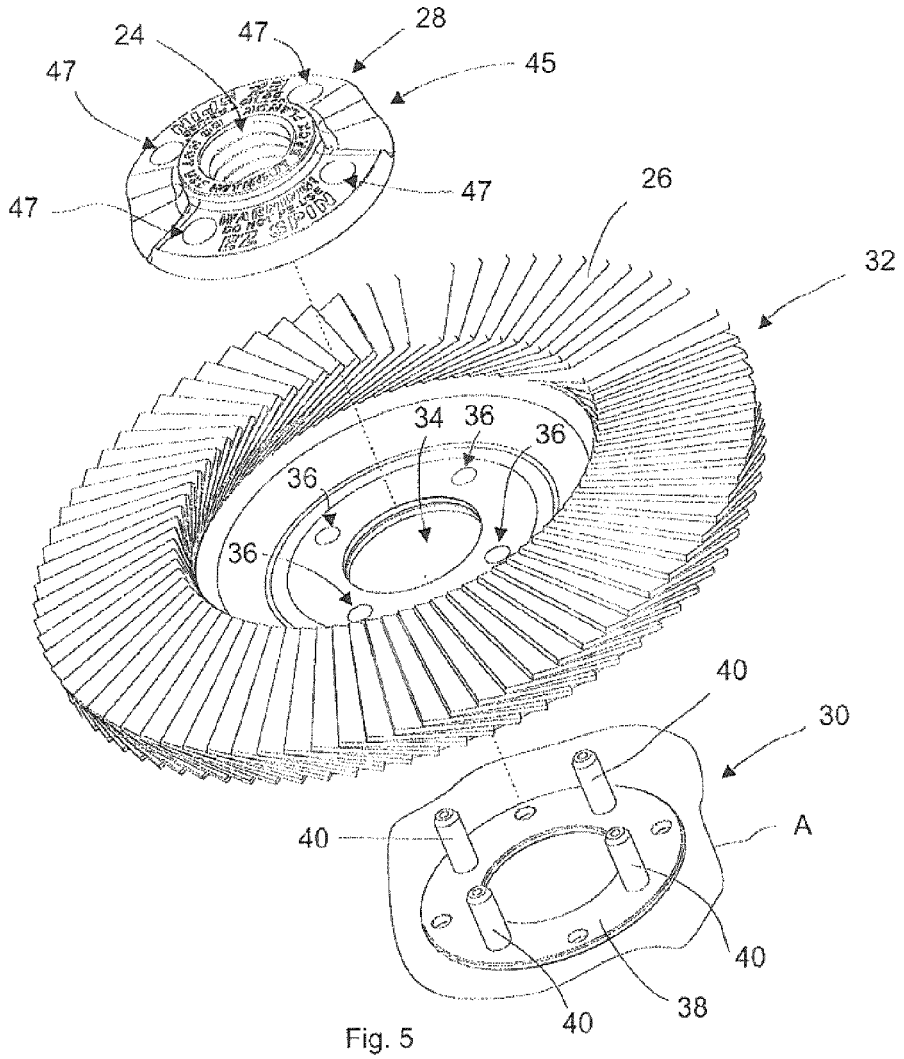
FIG. 5 is a pre-assembly view of encircled structure 3 of FIG. 2.

FIG. 5 shows the various components 28,30,32 which ultimately form the disc 20 in a pre-assembled state, and will be initially referenced, for clarity. Hub 28 is an injection-molded plastic piece and has formed therein a pair of opposed indents 45 and four sockets 47 surrounding the threaded bore 24. The annular element 32 providing the abrasive material 26 will be seen to include a central primary aperture 34 and two or more, specifically, four, secondary apertures 36 spaced about the primary aperture 34. The spacer structure 30 includes a pin element 40 for each secondary aperture 36. The spacer structure 30 also includes an annular component 38 spacing apart the pins 40 and from which the pins 40 rigidly extend.

Figure 6:
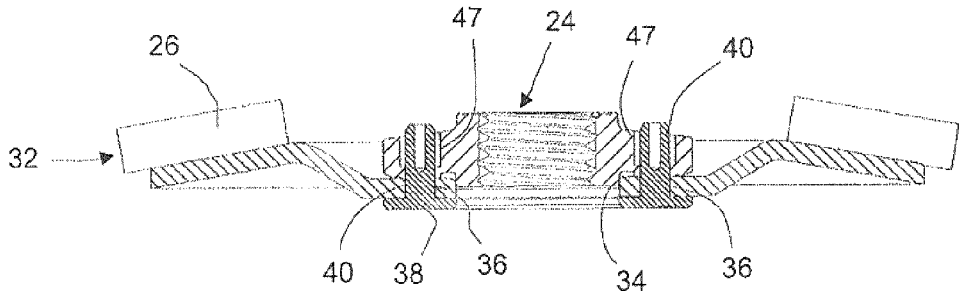
FIG. 6 is an assembled view, similar to FIG. 4, of the structure of FIG. 5.

The various pieces 28, 30, 32 are shown in an assembled state in FIG. 6. In this state, each pin element 40 extends through the secondary aperture 36 for which it is provided into a respective socket 47 and the central primary aperture 34 is aligned with the threaded bore 24 in hub 28.

Figure 4:
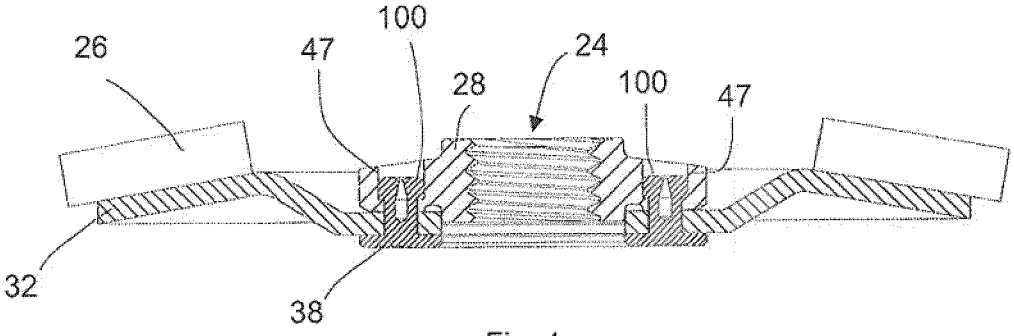
FIG. 4 is a view along section 4-4 of FIG. 3.

In order to produce the disc 20 from the structure shown in FIG. 6, one must merely deform the heads of the pins, through a staking process; the deformed heads are shown in the cross-section view of FIG. 4. The deformed heads 100 mechanically engage sockets 47. This secures the annular component 38 in spaced relation to the hub 28, with the abrasive element 32 sandwiched therebetween. The aligned central aperture 34 providing egress for the spindle 23 to the threaded bore 24 in use.

An advantage associated with this structure is the ease by which it is manufactured. The hubs 28 and spacer structures 30 can routinely be obtained by persons of ordinary skill in the art of injection molding. For both pieces, a suitable mold material is, for example, Nylon 66. The annular element 32 providing the abrasive material 26 is routinely obtainable by persons of ordinary skill in abrasives manufacture. Indeed, but for secondary apertures 36, annular element 32 itself can be substantially identical to abrasive structures commonly available in the marketplace. In annular elements wherein the central portion is fibreglass, secondary apertures 36 can be easily obtained through a simple punching operation. In annular elements wherein abrasive material composes the bulk of the part, apertures 36 will normally need to be produced when the central aperture 34 is produced, but again, this is a matter of routine to persons of ordinary skill.

Another advantage associated with the illustrated structure is the indents 45 which are provided on the hub 28, which enable to disc 20 to be finger manipulated without handling the abrasive 26. The openings in socket 47, however, also admit the use of a conventional spanner wrench (not shown), if additional force is necessary.

Various changes in, inter alia, size and shape of parts may be made. For example, the elements need not be round pins, but could take other cross-sectional shapes.

Figure 7:
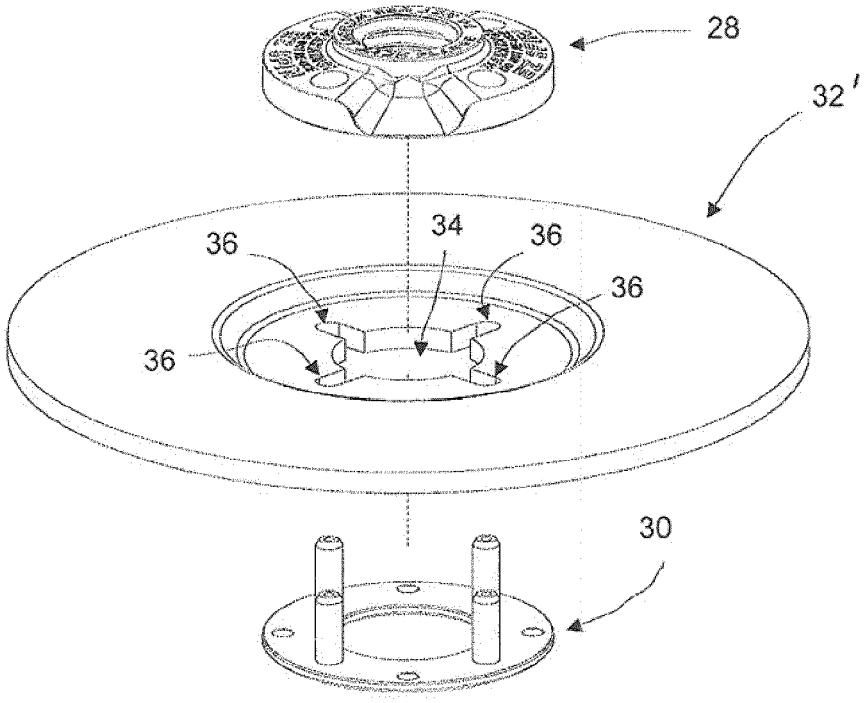
FIG. 7 is a view, similar to FIG. 5, of another exemplary embodiment.

By way of further example, FIG. 7 shows a structure with a modified annular element 32' wherein the apertures 36 are contiguous with, rather than separate from, central aperture 34.

Figure 8:
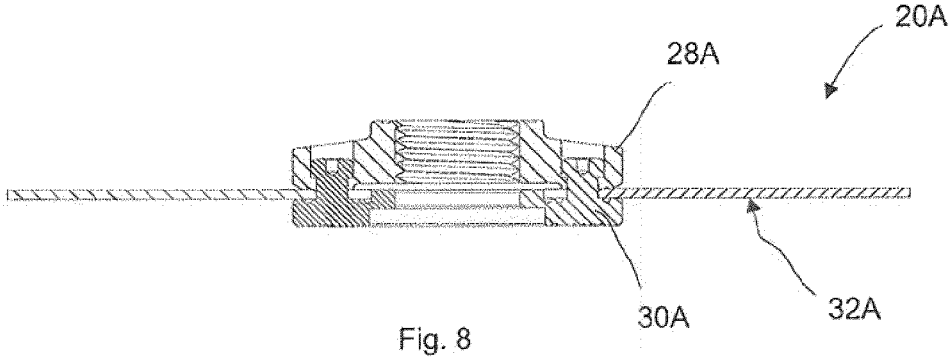
FIG. 8 is a view, similar to FIG. 4, of another exemplary embodiment.

FIG. 8, shows a modified version of the disc 20A, wherein another modified annular element 32A is provided, which is substantially planar, and modified versions of the hub 28A and spacer structure 30A are provided which have complementary geometries.

FIG. 9 shows a further modified spacer structure 30B. This structure 30B is also molded out of plastic, and voids 100 are formed, so as to provide thin walled break zones 102 in the modified pins 40B. An advantage associated with this structure is that, in the event that the disc binds in use, i.e. "grips rather than rips" the material being abraded, the pins 40B break, to permit the spindle of the grinder to rotate freely of the annular element 30. This can avoid wrist and other injuries that might otherwise result. In order to provide this functionality, it is important to ensure that the hub does not frictionally grip the annular element with substantial force. In FIG. 9, this is accommodated by configuring the hub to engage against the spacer structure, as indicated at areas X, but in applications wherein a spacer structure is not provided, this can equally be accommodated by arranging the hub to bear against the locating shoulder typically found on the grinder spindle, which shoulder is indicated as part Y in FIG. 2. The plastic chosen for molding should also be such that it tends to shear in the break zones, rather than simply deform; again, this is a matter of routine to persons of ordinary skill.

FIGS. 10 and 10.1 show a yet further modified disc 20C in cross-section. In this structure, modified pins 40C are provided, which mechanically engage modified sockets 47C without the need for a staking operation. This structure can simply be forced together. The between the pins 40C and sockets 47C is of the well-known technology employed in "zip ties" and the like.

FIG. 11 shows a yet further modified disc 20D in cross-section. In this structure, the pins are defined by rivets 40D, i.e. provided as discrete elements, separate from the other components, and deformed to provide for securement.

FIG. 12 shows a yet further modified disc 20E in cross-section. In this structure, the pins 40E engage the sockets 47E in press-fit, frictionally-engaged relation. Welding techniques, such as sonic welding, can also be employed, to strengthen the bond.

FIGS. 12.1 and 12.1.1 show a yet further modified disc 20F in cross-section. In this structure, two modified resilient pins 40F are provided, which engage in the socket 37 in snap-fit, mechanically-engaged relation.

FIGS. 13, 13.1 and 13.2 show a yet further modified disc 20G in cross-section. In this disc 20G, the pins 40G are provided on modified hub 28G, and engage in snap-fit relation within sockets 47G in modified annular element 32G.

Figure 14:
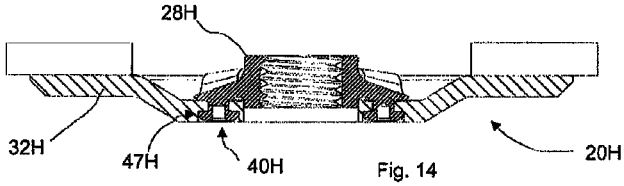
FIG. 14 is a view, similar to FIG. 4, of another exemplary embodiment.
Figure 15:
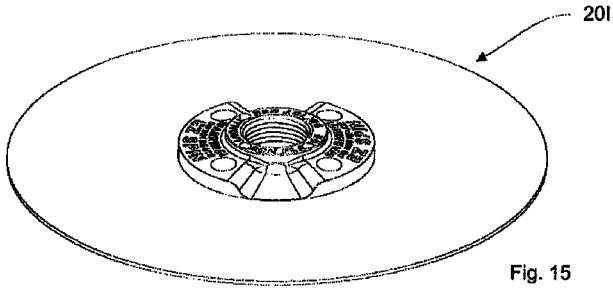
FIG. 15 is a perspective view of an abrasive disc according to another exemplary embodiment.
Figure 16:
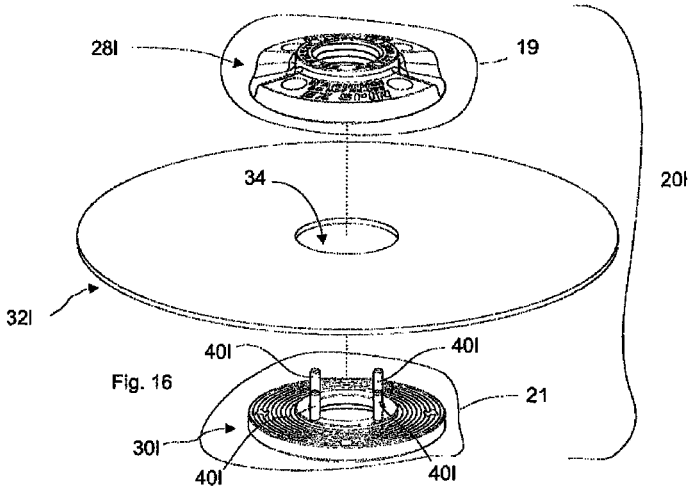
FIG. 16 is a pre-assembly view of the structure of FIG. 15.
Figure 17:
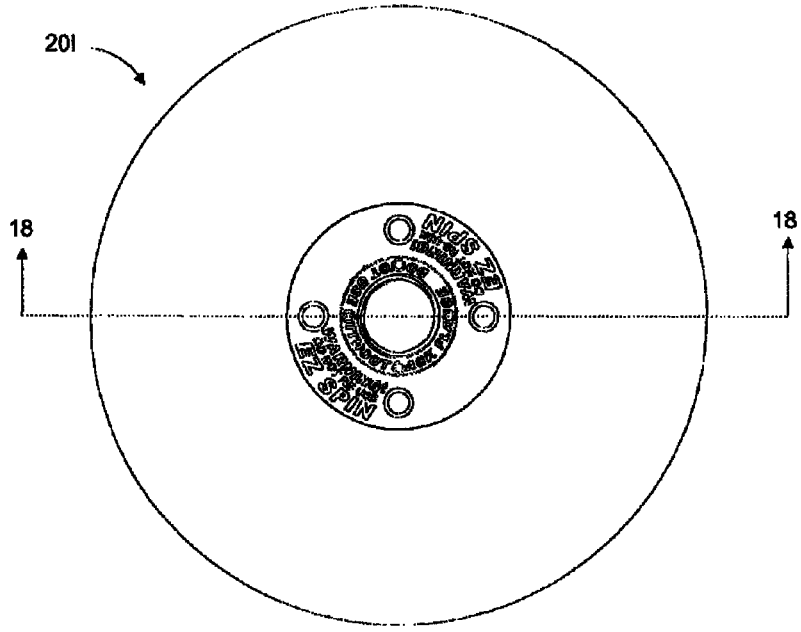
FIG. 17 is a plan view of the structure of FIG. 15.
Figure 18:
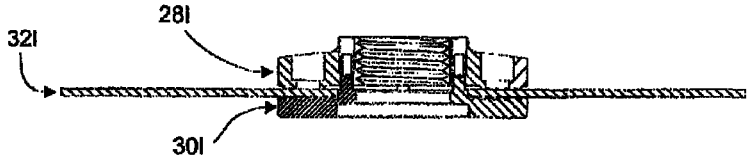
FIG. 18 is a view along section 18-18 of FIG. 17.
Figure 19:
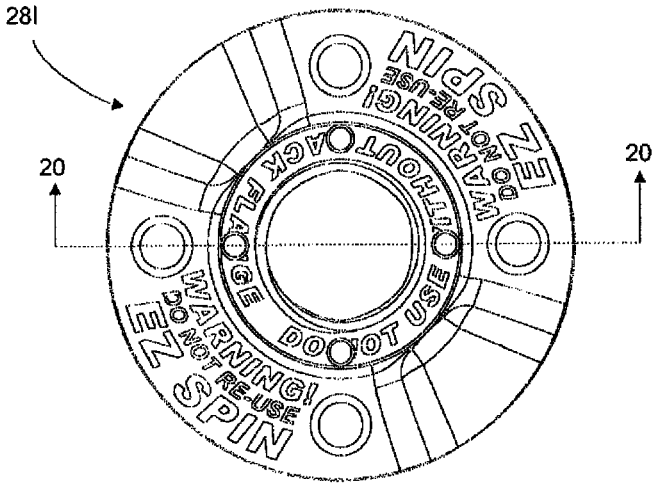
FIG. 19 is a plan view of encircled structure 19 of FIG. 16.
Figure 20:
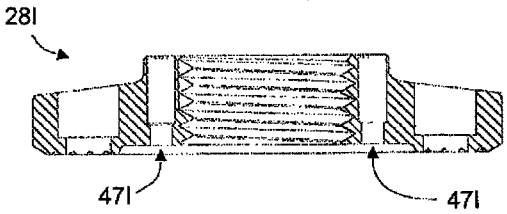
FIG. 20 is a view along section 20-20 of FIG. 19.
Figure 21:
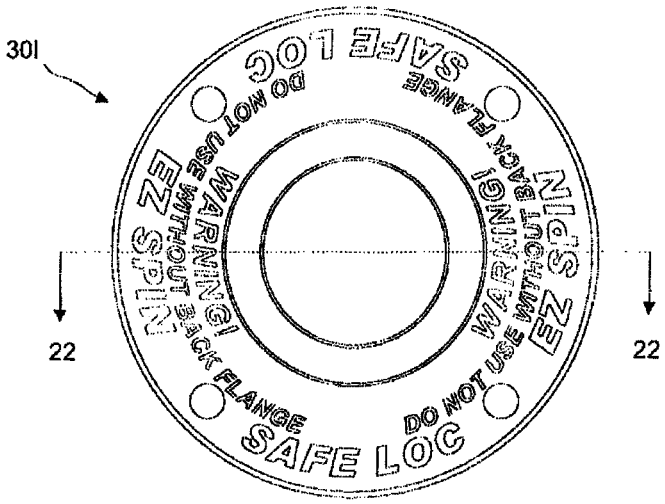
FIG. 21 is a plan view of encircled structure 21 of FIG. 16.
Figure 22:
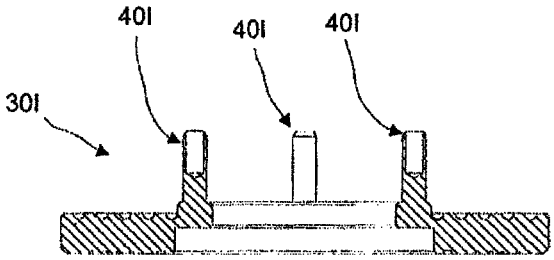
FIG. 22 is a view along section 22-22 of FIG. 21.

FIG. 14 shows a yet further modified disc 20H in cross-section. In this disc 20H, the pins 40H are formed integrally with modified hub 28H, and are deformed by a swaging operation in sockets 40H provided within modified annular element 32H.

FIGS. 15-22 detail a yet further modified disc 201. In this disc 201, pins 401 extend from modified spacer structure 301, through primary aperture 34 in sockets 471 formed in modified hub 281 and are secured together by glue (not shown).

Figure 23:
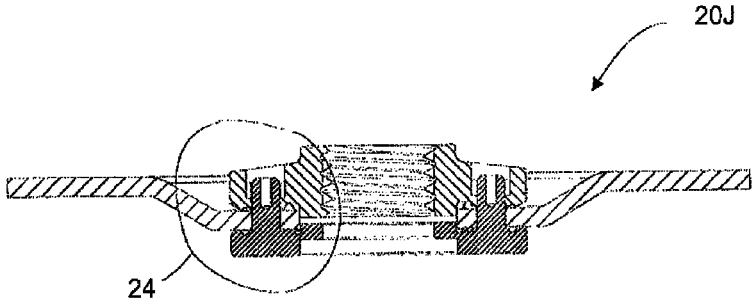
FIG. 23 is a view, similar to FIG. 4, of another exemplary embodiment.
Figure 24:
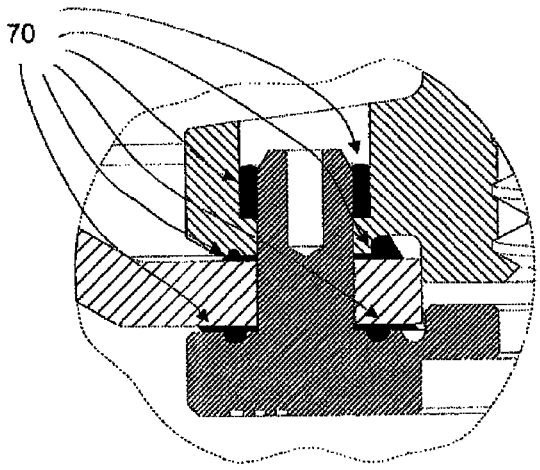
FIG. 24 is a view of encircled area 24 in FIG. 23.

FIGS. 23 and 24 show a yet further modified disc 20J. This disc 20J is substantially similar to disc 20, but adhesive 70 is provided to secure the various elements together.

Whereas only a finite number of exemplary embodiments are herein shown and described, the various embodiments presented above are merely examples and are in no way meant to limit the scope of this invention. Further variations of the innovations described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology and the invention.

Further, without intending to be limiting, it should be specifically understood that the invention can be incorporated into any grinding disc that normally runs with a ⅞ arbor hole on a ⅝-11 threaded spindle, and can be used with discs of varies thicknesses and types, including plastic, fibreglass and possibly even bonded.

Accordingly, the invention should be understood as limited only by the claims appended hereto, purposively construed.

The invention claimed is:

1. An improved abrasive disc for use with an angle grinder, the grinder being of the type having a threaded spindle and the disc being of the type having: a central portion defining a threaded bore for receiving said spindle; and abrasive material surrounding the central portion, wherein the improvement comprises: a hub defining the threaded bore; an annular element providing the abrasive material, the annular element having a central primary aperture aligned with the threaded bore in the hub to provide access to the bore by said spindle in use; and elements mechanically securing the hub to the annular element, for co-rotation; the annular element, but for the elements, being free to rotate about the spindle in use.

2. A disc according to claim 1, wherein the elements extend through the annular element to the hub.

3. A disc according to claim 2, wherein: the annular element has two or more secondary apertures spaced about the primary aperture; and the elements are provided one for each secondary aperture and extend therethrough to the hub.

4. A disc according to claim 2, further comprising a component spacing apart the elements and from which the elements extend.

5. A disc according to claim 4, wherein the hub has a socket for, and in receipt of, each element.

6. A disc according to claim 5, wherein the elements are secured to the hub by a method selected from the group of methods consisting of: frictional engagement of the elements by the hub; adhesive: mechanical engagement of the hub by the elements; welding.

7. A disc according to claim 5, wherein the elements have enlarged heads, disposed within the sockets and produced via a deformation operation, which mechanically secure the elements to the hub.

8. A disc according to claim 7, wherein the elements are selected from the group of elements consisting of: elements formed integrally with the component; and elements which are formed separately from each of the hub and the component and defined by rivets.

9. A disc according to claim 1, wherein the elements are formed integrally with the hub and extend therefrom through the annular element.

10. A disc according to claim 9, wherein: the annular element has two or more secondary apertures spaced about the primary aperture; and the elements are provided one for each secondary aperture and extend therethrough.

11. A disc according to claim 9, further comprising a component to which the elements extend.

12. A disc according to claim 11, wherein the component has a socket for, and in receipt of, each element.

13. A disc according to claim 12, wherein the elements are secured to the component by a method selected from the group of methods consisting of: frictional engagement of the elements by the component; adhesive: mechanical engagement of the component by the elements; and welding.

14. A disc according to claim 12, wherein the elements have enlarged heads, disposed within the sockets and produced via a deformation operation, which mechanically secure the elements to the component.

15. A disc according to claim 9, wherein the annular element has a socket for, and in receipt of, each element.

16. A disc according to claim 15, wherein the elements are secured to the annular element by a method selected from the group of methods consisting of: frictional engagement of the elements by the annular element; adhesive: mechanical engagement of the annular element by the elements; and welding.

17. A disc according to claim 15, wherein the elements have enlarged heads, disposed in the sockets and produced via a deformation operation, which mechanically secure the elements to the annular element.

18. A disc according to claim 1, wherein: the annular element has two or more secondary apertures spaced about the primary aperture; the elements are provided one for each secondary aperture and extend therethrough; and the elements are defined by rivets.

19. A disc according to claim 1, wherein the elements are pins and, in the event that the disc binds in use, the pins break, to permit the spindle and hub to rotate freely of the annular element.

20. An improved abrasive disc for use with an angle grinder, the grinder being of the type having a threaded spindle with a locating shoulder and the disc being of the type having: a central portion defining a threaded bore for receiving said spindle; and abrasive material surrounding the central portion, wherein the improvement comprises: a hub defining the threaded bore; an annular element providing the abrasive material, the annular element having a central primary aperture aligned with the threaded bore in the hub to provide access to the bore by said spindle in use; and elements mechanically securing the hub to the annular element, for co-rotation; the hub bearing against the locating shoulder in use such that, but for the elements, the annular element would be free to rotate about the spindle in use.

21. A disc according to claim 20, wherein the elements are pins that are adapted to break if the disc binds in use, to permit the spindle and hub to rotate freely of the annular element.

22. An improved abrasive disc for use with an angle grinder, the grinder being of the type having a threaded spindle and the disc being of the type having: a central portion defining a threaded bore for receiving said spindle; and abrasive material surrounding the central portion, wherein the improvement comprises: a hub defining the threaded bore; an annular element providing the abrasive material, the annular element having a central primary aperture aligned with the threaded bore in the hub to provide access to the bore by said spindle in use; elements mechanically securing the hub to the annular element, for co-rotation; and a component spacing apart the elements and from which the elements extend, the hub bearing against the component in use such that, but for the elements, the annular element would be free to rotate about the spindle.

23. A disc according to claim 22, wherein the elements are pins that are adapted to break if the disc binds in use, to permit the spindle and hub to rotate freely of the annular element.

* * * * *